United States Patent [19]

Perkin et al.

[11] Patent Number: 4,776,410

[45] Date of Patent: Oct. 11, 1988

[54] STABILIZING TOOL FOR WELL DRILLING

[75] Inventors: Gregg S. Perkin, Kingwood, Tex.; Duane D. Papke, Alberta, Canada

[73] Assignee: Oil Patch Group Inc., Alberta, Canada

[21] Appl. No.: 66,031

[22] Filed: Jun. 24, 1987

Related U.S. Application Data

[62] Division of Ser. No. 892,315, Aug. 4, 1986.

[51] Int. Cl.[4] ..... E21B 17/10

[52] U.S. Cl. ..... 175/325; 166/241

[58] Field of Search ..... 175/325, 323, 320; 166/241, 242, 243

[56] References Cited

U.S. PATENT DOCUMENTS

| | | | |
|---|---|---|---|
| 1,828,750 | 10/1931 | Raymond | 175/320 |
| 3,370,657 | 2/1968 | Antle | 166/241 |
| 3,680,646 | 8/1972 | Hughes et al. | 175/323 |
| 4,000,549 | 1/1977 | Brumley et al. | 175/325 |
| 4,231,437 | 11/1980 | Swersky et al. | 175/325 |
| 4,583,604 | 4/1986 | Greer | 175/325 |

*Primary Examiner*—Stephen J. Novosad
*Assistant Examiner*—Terry L. Melius
*Attorney, Agent, or Firm*—Dodge, Bush & Moseley

[57] ABSTRACT

A drilling tool for use in drilling operations for providing shock absorption capability and lateral support to the rotary drill string. The telescoping axial load shock absorber is positioned immediately adjacent at least one lateral support provided by a reamer or stabilizer. The stabilizer preferably employs a removable fixed blade secured to the tool by an undercut groove. The roller cutter for a reamer is also mounted in a preferred unique manner with the mounting blocks secured in a recess having an undercut retainer portion in the event of bolting failure. The mounting's brackets may be formed integral of the tool body or attached by welding or the like. A preferred form of mounting a blade on a stabilizer tool is also disclosed.

12 Claims, 4 Drawing Sheets

FIG. 8
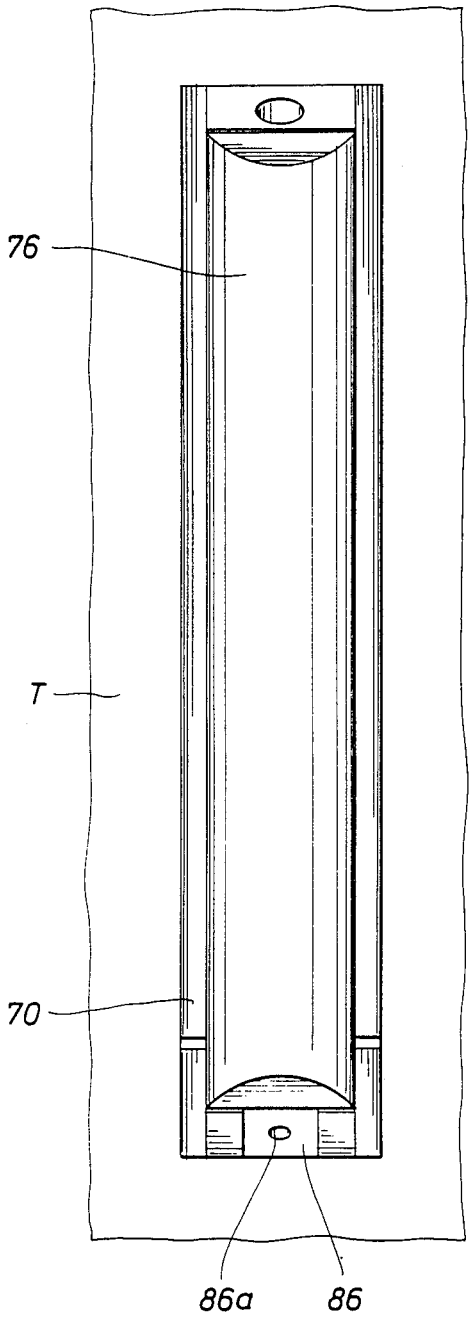
FIG. 9
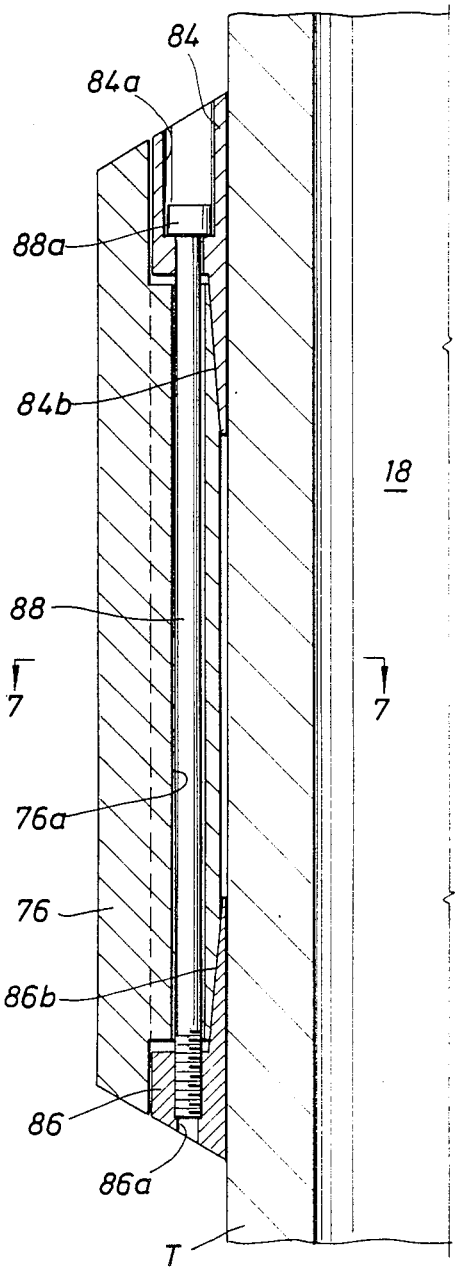
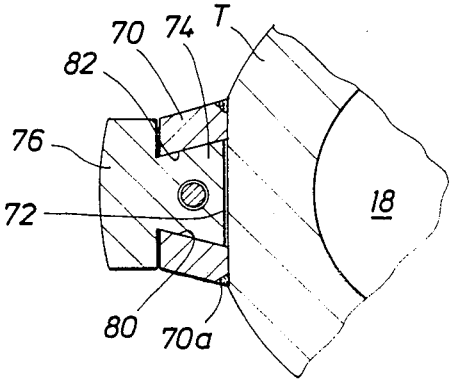
FIG. 7

STABILIZING TOOL FOR WELL DRILLING

This application is a divisional of application Ser. No. 892,315, filed Aug. 4, 1986.

BACKGROUND OF THE INVENTION

1. Field of the Invention

This invention relates generally to the field of a method and apparatus for drilling of wells and more particularly to a downhole well drilling apparatus and method of use for enhancing rotary well drilling operations.

2. Background Art

Most well drilling operations are conducted by rotary operations in which extendible lengths of drill string having a drill bit mounted at the lower end thereof are rotated from the earth's surface or by a down hole motor. Rotation of the drill string rotates the drill bit for extending the bore hole deeper into the earth during such drilling operations.

To enhance such rotary well drilling operations, numerous tools have been developed for mounting and use at sub-surface locations in the drill string to enhance the drilling operation. One such tool is called a reamer and is used to slightly underream, enlarge, straighten the maintain gage of a bore hole. Reamers, which are sometimes also used as drill string stabilizers, are conventionally supplied with a plurality of rotatable cutting blade rollers on a tubular member that contact the wall of the bore hole for enlarging the bore hole or removing the undesired obstruction. In some instances the term reamers are also described as a down hole milling or scraping tool used to cut or remove wall cake from the casing. The term reamer, as used herein, is not intended to cover a milling type of tool or the use of such a down hole drilling tool for removing the casing or a mud cake within the casing.

According to the 1986–87 edition of the *Composite Catalog of Oil Field Equipment and Services* published by Gulf Publishing of Post Office Box 2608, Houston, Tex., reamer tools with reference to specific volumes and page numbers, are presently commercially available in many embodiments for use from the following suppliers:

| | |
|---|---|
| REAMERS - Hole Opening: | |
| A-Z Int'l Tool Co. | 146 V-1 |
| C. P. Oil Tool Co. | 865 V-1 |
| Canamco Services & Supplies Int'l | 695 V-1 |
| Diamant Boart | 1547 V-1 |
| Drilco Division (Smith) | 1748 V-1 |
| Drillstar | 1775 V-1 |
| Driltrol | 1800 V-1 |
| Eastman Whipstock, Inc. | 1873 V-2 |
| Grant Tool Co. | 2339 V-2 |
| Haco Int'l Co. | 2387 V-2 |
| Industrialexportimport/Petromin | 3603 V-3 |
| S M F Int'l | 5809 V-4 |
| Security Division | 5663 V-4 |
| Texas Oil Tools, Inc. | 6155 V-4 |
| Tri-State Oil Tool Industries, Inc. | 6263 V-4 |
| Triumph-L O R, Inc. | 4304 V-3 |
| Wilson Industries, Inc. | 6796 V-4 |
| REAMERS - Jar & Key Seat: | |
| Bowen Tools, Inc. | 555 V-1 |
| Drilco Division | 1764 V-1 |
| Drillstar | 1786 V-1 |
| Driltrol | 1800 V-1 |
| Grant Oil Tool Co. | 2344 V-2 |
| Homco Int'l, Inc. | 2689 V-2 |

-continued

| | |
|---|---|
| Oilfield Mfg. Pte. Ltd. | 5158 V-4 |
| S M F Int'l | 5819 V-4 |
| Tri-State Oil Tool Industries, Inc. | 6261 V-4 |
| Wilson Industries, Inc. | 6796 V-4 |
| REAMERS - Rotary: | |
| Canamco Services & Supplies Int'l | 695 V-1 |
| Darron Oil Tools | 1452 V-1 |
| Diamant Boart | 1533 V-1 |
| Dreco Energy Services Ltd. | 1696 V-1 |
| Drilco Division | 1743 V-1 |
| Drillstar | 1779 V-1 |
| Driltrol | 1800 V-1 |
| Eastman Whipstock, Inc. | 1874 V-2 |
| Grant Oil Tool Co. | 2324 V-2 |
| Griffith Oil Tool Ltd. | 2357 V-2 |
| Industrialexportimport/Petromin | 3603 V-3 |
| Mento A/S | 4487 V-3 |
| Mid-Continent Supply Co. | 4589 V-3 |
| Oncor Products, Hughes Drilling Equip. | 3027 V-2 |
| S M F International | 5806 V-4 |
| Security Division | 5663 V-4 |
| Texas Oil Tools, Inc. | 6155 V-4 |
| Tri-State Oil Tool Industries, Inc. | 6261 V-4 |
| Triumph - L O R, Inc. | 4298 V-3 |
| Tsukamoto Seiki Co., Ltd. | 6299 V-4 |
| Wilson Industries, Inc. | 6796 V-4 |
| REAMERS - Stabilizing: | |
| Canamco Services & Supplies Int'l | 695 V-1 |
| Dreco Energy Services, Ltd. | 1696 V-1 |
| Drilco Division | 1743 V-1 |
| Driltrol | 1800 V-1 |
| Grant Oil Tool Co. | 2324 V-2 |
| Griffith Oil Tool Ltd. | 2357 V-2 |
| Haco Int'l | 2387 V-2 |
| Industrialexportimport/Petromin | 3603 V-3 |
| Oncor Products, Hughes Drilling Equip. | 3028 V-2 |
| S M F Int'l | 5806 V-4 |
| Security Division | 5663 V-4 |
| Triumph- L O R, Inc. | 4298 V-3 |
| Tsukamoto Seiki Co., Ltd. | 6299 V-4 |
| Wilson Industries, Inc. | 6796 V-4 |

U.S. Pat. No. 3,306,381 to Garrett, et al, which is assigned to the owner of Drilco, discloses a typical reaming tubular apparatus having a plurality of circumferentially spaced roller cutters mounted with hardened tungsten carbide cutting inserts externally protruding therefrom. The disclosed external bearings for the rollers are not sealed, although the use of sealed bearings is known and shown in the Drilco sales literature.

Another useful tool used in the drill string to enhance drilling operation is a stabilizer which contacts the bore hole wall and effectively serves as a radial bearing or lateral support for the rotating drill string in the bore hole. By holding the drill string against lateral forces or radial movement, the stabilizer serves to limit the unsupported column length of the drill string to prevent buckling as well as radial or lateral vibration, drill string diameter wear and the bending stress inducing movement of the drill string. In certain formations, a stabilizer also can be used enlarge the cylindrical bore hole side wall to a predetermined gauge or diameter. Stabilizers are usually formed by a tubular member with a plurality of outwardly extending fixed blades having wall contacting surfaces of hardened material that bear against or contact the sides of the borehole. The outwardly extending blades are usually mounted straight (vertical) or have a helical swirl. Various arrangements of mounting the blades, which may be field replaceable, also serve as a descriptive distinction of the types of various stabilizers.

The definition and use of stabilizers and reamers tend to overlap, but for purposes of distinguishing the two in this disclosure the term reamers will be limited to the rotatable cutting blade roller tools while stabilizers will be limited to rotating fixed blade tools.

The previously mentioned edition of the *Composite Catalog* also identifies the following suppliers of stabilizer tools:

| | |
|---|---|
| STABILIZERS - Casing, Drill Pipe & Tubing: | |
| A-1 Bit & Tool Co. | 103 V-1 |
| Arai Iron Works Co., Ltd | 245 V-1 |
| B J Products, Hughes Drilling Equipment | 2955 V-2 |
| Canamco Services & Supplies Int'l | 695 V-1 |
| Darron Oil Tools | 1448 V-1 |
| Grant Oil Tool Co. | 2324 V-2 |
| Haco Int'l Co. | 2387 V-2 |
| Industrialexportimport/Petromin | 3603 V-3 |
| Mento A/S | 4487 V-3 |
| Oncor Products, Hughes Drilling Equipment | 3030 V-2 |
| Petco | 5401 V-4 |
| S.E.A. Supply Co., Inc. | 2209 V-2 |
| S M F Int'l | 5798 V-4 |
| STABILIZERS - Clamp on: | |
| Drilco Division | 1764 V-1 |
| Reed Tool Co. | 5525 V-4 |
| S M F Int'l | 5801 V-4 |
| STABILIZERS - Cushion: | |
| Chimo Polyurethanes Ltd. | 1279 V-1 |
| Driltrol | 1802 V-1 |
| Grant Oil Tool Co. | 2328 V-2 |
| STABILIZERS - Diamond: | |
| B J Products, Hughes Drilling Equipment | 2969 V-2 |
| Diamant Boart | 1551 V-1 |
| J. K. Smit & Sons Diamond Tools Ltd. | 5757 V-4 |
| STABILIZERS - Drill Collar: | |
| Silvio Ballerini & C. S.P.A. | 387 V-1 |
| Bowen Tools, Inc. | 512 V-1 |
| Canamco Services & Supplies Int'l | 695 V-1 |
| Cutting & Wear Resistant Developments | 1349 V-1 |
| Darron Oil Tools | 1448 V-1 |
| Diamant Boart | 1551 V-1 |
| Drilco Division | 1732 V-1 |
| Driltrol | 1801 V-1 |
| Grant Oil Tool Co. | 2325 V-2 |
| Haco International Co. | 2387 V-2 |
| Hendershot Tool Co. | 2654 V-2 |
| Industrialexportimport/Peromin | 3603 V-3 |
| O K G T | 5123 V-4 |
| Oncor Products, Hughes Drilling Equipment | 3030 V-3 |
| Reed Tool Co. | 5525 V-4 |
| S M F International | 5799 V-4 |
| Teleco Oilfield Services, Inc. | 6051 V-4 |
| Triumph - L O R, Inc. | 4290 V-3 |
| Tsukamoto Seiki Co., Ltd. | 6298 V-4 |
| Vereinigte Edelstahlwerke V E W | 6481 V-4 |
| Walker - Neer Manufacturing Co., Inc. | 6618 V-4 |
| Wilson Industries, Inc. | 6792 V-4 |
| STABILIZERS - Free Wheeling: | |
| A-1 Bit & Tool Co. | 103 V-1 |
| A-Z International Tool Co. | 145 V-1 |
| Drilstar | 1786 V-1 |
| Oncor Products, Hughes Drilling Equipment | 3031 V-2 |
| Triumph - L O R, Inc. | 4296 V-3 |
| STABILIZERS - Integral Blade: | |
| Bowen Tools, Inc. | 512 V-1 |
| Canamco Services & Supplies Int'l | 695 V-1 |
| Christensen, Inc. | 5047 V-3 |
| Cutting & Wear Resistant Developments | 1349 V-1 |
| Dailey Petroleum Services Corp. | 1364 V-1 |
| Darron Oil Tools | 1448 V-1 |
| Diamant Boart | 1551 V-1 |
| Dreco Energy Services Ltd. | 1696 V-1 |
| Drilco Division | 1735 V-1 |
| Drillstar | 1776 V-1 |
| Driltrol | 1802 V-1 |
| Eastman Whipstock, Inc. | 1869 V-2 |
| Grant Oil Tool Co. | 2330 V-2 |
| Griffith Oil Tool Ltd. | 2357 V-2 |
| Haco Int'l Co. | 2387 V-2 |
| Hunting Oilfield Services Ltd. | 3200 V-2 |
| Norton Christensen, Inc. | 5047 V-3 |

-continued

| | |
|---|---|
| Oilfield Mfg. Pte. Ltd. | 5154 V-4 |
| Oncor Products, Hughes Drilling Equip. | 3034 V-2 |
| Reed Tool Co. | 5525 V-4 |
| S M F International | 5797 V-4 |
| Security Division | 5663 V-4 |
| Triumph - L O R, Inc. | 4290 V-3 |
| Tsukamoto Seiki Co., Ltd. | 6298 V-4 |
| Vereinigte Edelstahlwerke V E W | 6481 V-4 |
| Walters Oil Tool Machine Ltd. | 6628 V-4 |
| Wilson Industries, Inc. | 6796 V-4 |
| STABILIZERS - Mill: | |
| Cutting & Wear Resistant Developments | 1349 V-1 |
| Darron Oil Tools | 1448 V-1 |
| Driltrol | 1802 V-1 |
| Tri-State Oil Tool Industries, Inc. | 6261 V-4 |
| Wilson Industries, Inc | 6796 V-4 |
| STABILIZERS - Non-Magnetic: | |
| Christensen, Inc. | 5048 V-3 |
| Cutting & Wear Resistant Developments | 1349 V-1 |
| Darron Oil Tools | 1450 V-1 |
| Diamant Boart | 1551 V-1 |
| Norton Christensen, Inc. | 5048 V-3 |
| Reed Tool Co. | 5525 V-4 |
| SMF International | 5796 V-4 |
| Teleco Oilfield Services Inc. | 6051 V-4 |
| Tirumph-LOR, Inc. | 4290 V-3 |
| Vereinigte Edelstahlwerke VEW | 6481 V-4 |
| Wilson Industries, Inc. | 6796 V-4 |
| STABILIZERS - Packed Hole Assemblies: | |
| Christensen, Inc. | 5045 V-3 |
| Diamant Boart | 1551 V-1 |
| Draco Energy Services Ltd. | 1696 V-1 |
| Driico Division | 1732 V-1 |
| Driltrol | 1801 V-1 |
| Grant Oil Tool Co. | 2324 V-2 |
| Norton Christensen, Inc. | 5045 V-3 |
| Oncor Products, Hughes Drilling Equipment | 3026 V-2 |
| SMF International | 5797 V-4 |
| Security Division | 5663 V-4 |
| Vereinigte Edelstahlwerke VEW | 6481 V-4 |
| Wilson Industries, Inc. | 6796 V-4 |
| STABILIZERS - Pulsation: | |
| Fluid Kinetics Corp. | 1955 V-2 |
| Holthuis B.V./GEHO | 2667 V-2 |
| Joy Petroleum Equipment Group | 3773 V-3 |
| STABILIZERS - Replaceable Pad: | |
| Drilco Division | 1732 V-1 |
| Grant Oil Tool Co. | 2329 V-2 |
| Oncor Products, Hughes Drilling Equipment | 3034 V-2 |
| SMF International | 5800 V-4 |
| Triumph-LOR, Inc. | 4299 V-3 |
| STABILIZERS - Rubber: | |
| B J Products, Hughes Drilling Equipment | 2953 V-2 |
| Chimo Polyurethanes Ltd. | 1279 V-1 |
| Drilco Division | 1740 V-1 |
| Drillstar | 1778 V-1 |
| Driltrol | 1802 V-1 |
| Grant Oil Tool Co. | 2328 V-2 |
| Regal International, Inc. | 5573 V-4 |
| SMF International | 5803 V-4 |
| Triumph-LOR, Inc. | 4296 V-3 |
| Vereinigte Edelstahlwerke VEW | 6481 V-4 |
| STABILIZERS - Sleeve: | |
| Canamco Services & Supplies International | 695 V-1 |
| Chimo Polyurethanes Ltd. | 1279 V-1 |
| Christensen, Inc. | 5049 V-3 |
| Cutting & Wear Resistant Developments | 1351 V-1 |
| Darron Oil Tools | 1449 V-1 |
| Diamant Boart | 1551 V-1 |
| Drilco Division | 1735 V-1 |
| Drillstar | 1776 V-1 |
| Driltrol | 1801 V-1 |
| Eastman Whipstock, Inc. | 1867 V-2 |
| Grant Oil Tool Co. | 2331 V-2 |
| Haco International Co. | 2387 V-2 |
| Norton Christensen, Inc. | 5049 V-2 |
| Oilfield Mfg. Pte. Ltd. | 5167 V-4 |
| Oncor Products, Hughes Drilling Equipment | 3031 V-2 |
| Reed Tool Co. | 5525 V-4 |
| SMF International | 5798 V-4 |

-continued

| | |
|---|---|
| Security Division | 5663 V-4 |
| Tri-State Oil Tool Industries, Inc. | 6261 V-4 |
| Triumph-LOR, Inc. | 4296 V-3 |
| Tsukamoto Seiki Co., Ltd. | 6298 V-4 |
| Vereinigte Edelstahlwerke VEW | 6481 V-4 |
| STABILIZERS - Spiral Blade: | |
| Bowen Tools, Inc. | 512 V-1 |
| Canamco Services & Supplies International | 695 V-1 |
| Cutting & Wear Resistant Developments | 1349 V-1 |
| Darron Oil Tools | 1448 V-1 |
| Diamant Boart | 1551 V-1 |
| Dreco Energy Services Ltd. | 1696 V-1 |
| Drilco Division | 1735 V-1 |
| Drillstar | 1776 V-1 |
| Driltrol | 1802 V-1 |
| Grant Oil Tool Co. | 2324 V-2 |
| Griffith Oil Tool Ltd. | 2357 V-2 |
| Haco International Co. | 2367 V-2 |
| Industrialexportimport/Petromin | 3603 V-3 |
| Oncor Products, Hughes Drilling Equipment | 3030 V-2 |
| Reed Tool Co. | 5525 V-4 |
| SMF International | 5797 V-4 |
| Security Division | 5663 V-4 |
| Tri-State Oil Tool Industries, Inc. | 6261 V-4 |
| Triumph-LOR, Inc. | 4290 V-3 |
| Vereinigte Eldelstahlwerke VEW | 6481 V-4 |
| Wilson Industries, Inc. | 6796 V-4 |
| STABILIZERS - Suction: | |
| Joy Petroleum Equipment Group | 3773 V-3 |
| STABILIZERS - Turbo Lift: | |
| Darron Oil Tools | 1448 V-1 |
| Datadril Division | 1453 V-1 |
| STABILIZER - Welded Blade: | |
| A-1 Bit & Tool Co. | 103 V-1 |
| Bowen Tools, Inc. | 512 V-1 |
| Darron Oil Tools | 1448 V-1 |
| Dreco Energy Services Ltd. | 1696 V-1 |
| Drilco Division | 1742 V-1 |
| Drillstar | 1776 V-1 |
| Driltrol | 1802 V-1 |
| Eastman Whipstock, Inc. | 1868 V-2 |
| Grant Oil Tool Co. | 2330 V-2 |
| Griffith Oil Tool Ltd. | 2357 V-2 |
| Haco International Co. | 2367 V-2 |
| Hendershot Tool Co. | 2654 V-2 |
| Oilfield Mfg. Pte. Ltd. | 5167 V-4 |
| SMF International | 5797 V-4 |
| Tri-State Oil Tool Industries, Inc. | 6261 V-4 |
| Triumph-LOR, Inc. | 4294 V-3 |
| Tsukamoto Seiki Co., Ltd. | 6296 V-4 |
| Wilson Industries, Inc. | 6796 V-4 |

U.S. Pat. No. 3,680,647 to Dixon and Crews, which is also assigned to the owner of Drilco, discloses a square drill collar type fixed blade stabilizer used for drill bit stabilization and deviation control. As noted therein, stabilizers can be further characterized as non-rotating or rotating. The so called non-rotating types employ a fixed well bore wall protective sleeve member which is rotatably mounted on the drill stem attached stabilizer body and for purposes of the patent invention will be considered a fixed blade stabilizer. Crews combines a fixed blade stabilizer and drill collar in a single tool equipped with field replaceable vertical wear blades received in specially formed longitudinally extending grooves. Such tool is also disclosed in Drilco's "RWP" or replaceable wear pad stabilizer sales literature.

Of particular interest is the prior art illustration of FIG. 1 of the patent which shows six different drill string mounting arrangements of various individual separate downhole drilling tools such as non-rotating stabilizers, a roller cutter reamer - stabilizer, fixed blade rotary stabilizers and square drill collars above the drill bit. Each individual tool performs a separate function independent of the others and requires make-up of two threaded connections in the drill string. As the threaded connections are weak points and subject to failure they are necessary, but undesirable.

In Pat. No. 3,754,609 to Garrett (also Drilco) a flexible threaded end connector is disclosed for use with reamer - stabilizer of the fixed helical blade type with the blades formed on a replaceable sleeve. The flexible connector attempted to protect the threads by preventing leakage and providing proper torque transfer when the drill string is subjected to buckling or bending from compressive loading.

In U.S. Pat. No. 4,428,626, to Blau et al, a releasable mounting arrangement for hardened well contacting inserts or blades to a stabilizer is disclosed. A closed end undercut vertical slot or groove is formed on the tool with a central full non-undercut release opening for the slot. A retainer block having a plurality of spring loaded detents is secured in the opening to maintain the wear pads locked into the groove. Additional back up friction lock means may be provided if necessary. In FIG. 13, an undercut groove embodiment for mounting a longitudinally spaced pair of non-lubricated mounting blocks for a roller cutter reamer tool is disclosed.

U.S. Pat. Nos. 3,773,359 and 3,784,238 discloses an intermediate drill stem used to distribute the bending load from the stiff heavy drill collars used to weight the drill bit to the more flexible drill pipe and in which the threaded end connections are made more rigid than the body to preferentially bend the body. The stronger ends are intended to protect the weaker make up threads from plastic deformation due to excessive stress loading from drill string bending stresses induced during operation. The longitudinally spaced protective collars are hardened to prevent excessive wear from contact with the bore hole wall.

U.S. Pat. No. 3,818,999 to Garrett discloses a rotating fixed blade stabilizer of the square drill collar type. The field replaceable hardened wear inserts are received in the 90° angled vertically extending grooves and are secured therein by bolting.

A third type of useful tool used in the drill string to enhance drilling operation is a shock absorber tool which is preferably run connected directly to the drill bit and below the drill collars. This longitudinally telescoping tool is intended to damper out the vibration and axial movement of the drill bit resulting from the rotational movement of the drill bit which excites or vibrates the drill string. The shock absorber's primary purpose is to maintain the cutting edge of the drill bit in optimum cutting contact with the formation at all times.

The shock absorbing tool should be contrasted with the bumper sub which is a slip-joint tool that is used in the string of drill pipe when drilling from a floating vessel to absorb the vertical motion of the vessel caused by wave action. The bumper sub slip-joint is inserted above the heavy drill collars in order to maintain the weight of collars on the drill bit as the drill pipe above the slip-joint moves up and down with the motion of the vessel. The bumper sub is also a term used in fishing operations to describe and identify a tool that imparts a jarring action to the fishing string to help free the "fish". The shock absorber tool is also not to be confused with the drilling jar tool which is used to deliver a jarring impact to free a drill string stuck in the bore hole as described in U.S. Pat. No. 4,284,153 to Reaugh.

The drilling shock absorbing tool is generally formed of two tubular assemblies secured in a relatively movable longitudinal telescoping relationship and which are splined or otherwise restrained to prevent relative circumferential rotation. A resilient vibration dampening means is operably connected between the two tubular assemblies to absorb and virtually eliminate the variable dynamic loading on the drill bit. Dampening is usually provided by mechanical springs, trapped fluid and or gas, resiliently deformable rubber members or combinations thereof which resist the axial compressive stroke. To be most effective the shock absorber is run immediately above the drill bit and below the drill collars. The stability or stiff column characteristics of the shock absorber tool is adversely affected by the necessity for the longitudinal operating stroke or telescoping movement which usually results in a bending resistant weak point in the drill collar portion of the string. As this weakness can result in uncontrolled deviation of the borehole direction it is highly undesirable. Prior efforts to correct this weakness have not been commercially successful or accepted with serious reservations.

The *Composite Catalog* 1986–87 edition lists the following Drilling Tool Shock Absorber suppliers:

| ABSORBERS - Shock, Drilling: | |
|---|---|
| B J Products, Hughes Drilling Equip. | 3036 V-2 |
| Bowen Tools, Inc. | 563 V-1 |
| Brown Products, Hughes Production Tools | 3047 V-2 |
| Canamco Services & Supplies Int'l | 695 V-1 |
| Christensen, Inc. | 5042 V-3 |
| Cougar Tool | 1315 V-1 |
| Dailey Petroleum Services Corp. | 1360 V-1 |
| Dreco Energy Services Ltd. | 1692 V-1 |
| Drilco Division | 1751 V-1 |
| Griffith Oil Tool Ltd. | 2357 V-2 |
| Hawn Tool Co. | 2662 V-2 |
| Hunt Oil Tool Co. | 3219 V-2 |
| Jarco Services, Inc | 3692-3 V-3 |
| Mento A/S | 4487 V-3 |
| Norton Christensen, Inc. | 5042 V-3 |
| Positive Action Tool | 5453 V-4 |
| Security Division | 5664 V-4 |
| Swaco Division | 5945 V-4 |
| Triumph - L O R, Inc. | 4288 V-3 |

U.S. Pat. No. 3,660,990 to Zerb, et al and No. 3,774,731 to Zerb alone disclose shocker absorber tools and are both entitled "Vibration Damper". Both patents now owned by the owner of the present invention employ a rubber elements as a resilient dampening means.

U.S. Pat. No. 3,099,918 to Garrett (Drilco) discloses a telescopic shock absorber tool preferably run between the drill bit and the drill collars to dampen vibrations and impacts induced by the drill bit. A rubber resilient sleeve is employed as the dampening mechanism. U.S. Pat. No. 3,254,508 was also granted to Garrett for a shock absorber tool using a unique corrugated metal spring for resiliency. Garrett U.S. Pat. No. 3,447,340 is an improvement of the shock absorber metal spring formed with helical grooves to improve useful spring life.

U.S. Pat. No. 4,428,443 to Oliphant identifies and classifies by resilient member a number of prior art patents as well as disclosing a slotted metal spring member. U.S. Pat. No. 4,443,206 to Teng also discloses a shock absorber well tool in which a rubber resilient element is employed as well as a unique helical spline means.

U.S. Pat. No. 4,211,290 to Mason, et al discloses a shock absorbing tool having a deformable element formed by a stack of alternate layers of non-deformable metal washer and deformable elastomer rings. The deformable element is protected in an oil bath filled expansible chamber having a floating piston to equalize the sealed oil bath pressure with the internal drilling fluid pressure. By equalizing these pressures, undesired preloading of the resilient element by the hydrostatic head is avoided.

Three types of prior art shock absorbers are identified in the background of the invention of the Mason patent.

In the first type, the telescoping tubular sections are sealed in such a manner that internal well fluid hydrostatic pressure urges against the resilient or deformable element used to expand the tubular sections. Under deep well operating conditions the hydrostatic pressure "pre-loading" action overcomes even a "hard" deformable element. In those circumstances, the deformable element is essentially rigid and the shock absorber tool rendered ineffective.

In a second type of tool, the telescoping elements are sealed with a floating piston to equalize the chamber internal pressure and the hydrostatic pressure. Hard, compressible metal wire elements disposed in the chamber are used to resist the compressive loading on the tool.

A third type provides a relatively "soft" resilient element in a sealed chamber that is pressure equalized. A gas pressure zone is provide in the chamber as a resilient element which results in a soft spring type urging at shallow drilling depths and a hard spring type urging at deeper depths.

A characteristic of most shock absorbing tools is that the spring rate of the resilient element increases as the compressive loading increases. FIG. 15 of the Mason patent illustrates such relationship in graph form and describes the spring rate (average) as the load required to deflect the spring a total of one inch (2.54 cm). The spring characteristic curve for "soft", "moderate" and "hard" deformable resilient elements are plotted.

The Mason patent invention attempted to overcome the hydrostatic preloading problem using a pressure equalized annular expansible chamber containng the deformable element. Desirably, the resilient element does not contact the side walls of the expansible chamber and is formed of a layered stack of annular segments of non-deformable steel rings and deformable elastic rings arranged in alernating sequence. Such arrangement distributes the axial shock load uniformly throughout the length of the resilient element.

Mason, et al, is also concerned with the problem of lack of lateral rigidity in a shock absorber which may cause undesired bore hole deviation and high spline wear. However, no lateral support means for the shock absorber is disclosed.

The Maurer Engineering, Inc., 2916 West T. C. Jester, Houston, Tex. 77018, undated shock absorber sales literature discloses a relatively short sub designed to be run immediately above the bit having a pressure balanced expansible chamber in which a Belleville spring resilient means located. Use of soft, medium and hard spring arrangements are disclosed to meet anticipated operating axial shock loads. The catalogue further suggests a combination stabilizer/shock absorber tool can be custom tailored if desired for specific applications, but contains no such disclosure.

With this helpful background category of the various types of shock absorber tools a brief review of the *Composite Catalog* suppliers is greatly simplified.

The Griffith Oil Tools, 4600 Post Oak Place, Houston, Tex. 77027, 1982–83 Catalog shows two shock tools at pages 3706–3709. The embodiment illustrated at page 3707 shows resilient springs in an oil filled chamber. The tool is pressure balanced to keep the tool from closing in response to hydrostatic pressure. The Griffith export shock tool embodiment disclosed at page 3709 is substantially identical and provided with higher spring rates and shorter spline, but is not field repairable. Note the recognition of the desirability to run such tools immediately above the drill bit to minimize the oscillating mass being dampened by the tool.

The Trumph—LOR type Z Dampening Sub at page 4288 of the *Composite Catalog* employs on all metal resilient springs in an oil bath chamber having a floating piston arrangement which compensates for thermal expansion of the oil filled chamber and downhole hydrostatic pressure. A two stage resilient system employing metal ring springs is disposed in the chamber. One stage of springs is provided with a soft spring constant while the other stage provides a hard spring constant to ensure proper operation through a wide range of bit weights.

The long stroke Bowen Cushion Sub disclosed at page 1301 of the *Composite Catalog* also utilizes an oil filled chamber housing the "low spring rate" resilient member.

The Drilco steel spring "Shock Sub" disclosed at pages 2792 and 2793 employs a helical bellows-type spring that is more fully disclosed in the Garrett patents mentioned above.

The Hawn Tool Company shock absorber tool disclosed at page 4076 employs a preselected size floating piston orifice and a check valve to control the transferred of the trapped hydraulic fluid between sealed chambers. A seal failure renders the tool inoperative.

The Schlumberger shock absorber tool material (page 5005) discloses a hydraulically balanced tool having a constant rate metal spring disposed in the oil filled dampening chamber. Protected involute splines are used to reduce bearing contact pressure while providing high torsional strength. Note the typical suggested running relationship directly above the bit or between reamers and/or stabilizers for stabilization.

The Christensen "Shock-Eze" shock absorber tool (page 2028) employs a set of stacked Belleville springs as the resilient elements in an oil filled and sealed chamber. The long (5 in.) stroke enables the preloaded metal spring to operate in both directions.

The Security Dresser shock absorber displayed at *Composite Catalog* page 2704 employs a pressure balanced sealed chamber in which a metal Belleville spring arrangement provides the resilient element.

The Bat-Jac shock absorber at page 419 also provides a Belleville metal spring stack that is reinforced by fluid pressure.

The foregoing patents and publications are fully incorporated herein by specific reference for any and all purposes. Such listing of patents and publications is presented as neither exhaustive or comprehensive, but rather as representative of the known material prior art.

SUMMARY OF THE INVENTION

The present invention relates to the field of sub-surface tools used in and for enhancing rotary well drilling operations. In particular the present invention relates to a multi-purpose shock absorber tool having lateral bore hole wall support to increase drilling stability. The relatively short shock absorber tool is formed by two telescoping tubular assembly forming a sealed central flow path for the drilling fluid and an expansible chamber. The expansible chamber is filled with a suitable protective clean liquid or gas and is sealed in a manner to control hydrostatic fluid forces.

The resilient element for absorbing the vibration is disposed in the expansible chamber and may be provided in any of the known or conventional forms. In a preferred embodiment, a replaceable cartridge of stacked elastomer cushion elements and Belleville springs (washers) are utilized to provide a desired spring constant. The resilient element is preloaded by fluid or gas pressure to operate in both directions.

Preferably, the upper or outer tubular assembly of the shock absorber mounts a stabilizer radial support while the inner mandrel or lower tubular assembly carries either a stabilizer or a reamer for lateral support. By connecting the shock absorber tool directly to the drill bit, optimum stabilization and reaming as well as shock absorbing is obtained. The relatively weak point telescoping section is supported more effectively by the relatively short unsupported length of the shock absorber tool between the lateral supports while positioning the shock absorption as close as possible to the drill bit. In addition, at least two threaded make-up connections are eliminated from the drill collar portion of the drill string.

The upper tubular assembly stabilizer is preferably provided with integral blades, with replaceable blades, or with welded blades although any form of bore wall contacting stabilizer may be used. The lower mandrel is preferably formed with a reamer having sealed or non-sealed roller cutter bearings. When a stabilizer is mounted on the lower mandrel it may be an integral or welded blade stabilizer or a removable jacket or sleeve-type that is also retained on the lower mandrel by make-up of the drill bit.

One preferred form of the reamer employs roller mounting blocks which are secured by bolting in undercut recesses to assure retention in the event of bolting failure. The shaft bearings for the roller reamers may be sealed or unsealed, but if sealed a pressure compensated seal mechanism is provided for the seal chamber to provide for thermal expansion of the lubricant and for hydrostatic pressure balancing.

A preferred form of stabilizer fixed blade attachment is also disclosed in which the removable blade is fixed within an undercut dove-tail groove by suitable bolting.

BRIEF DESCRIPTION OF THE DRAWINGS

FIG. 7, 8 and 9 are views of a preferred dove-tail mounting of a replaceable blade for a stabilizer.

DESCRIPTION OF THE PREFERRED EMBODIMENT

Figure 1:
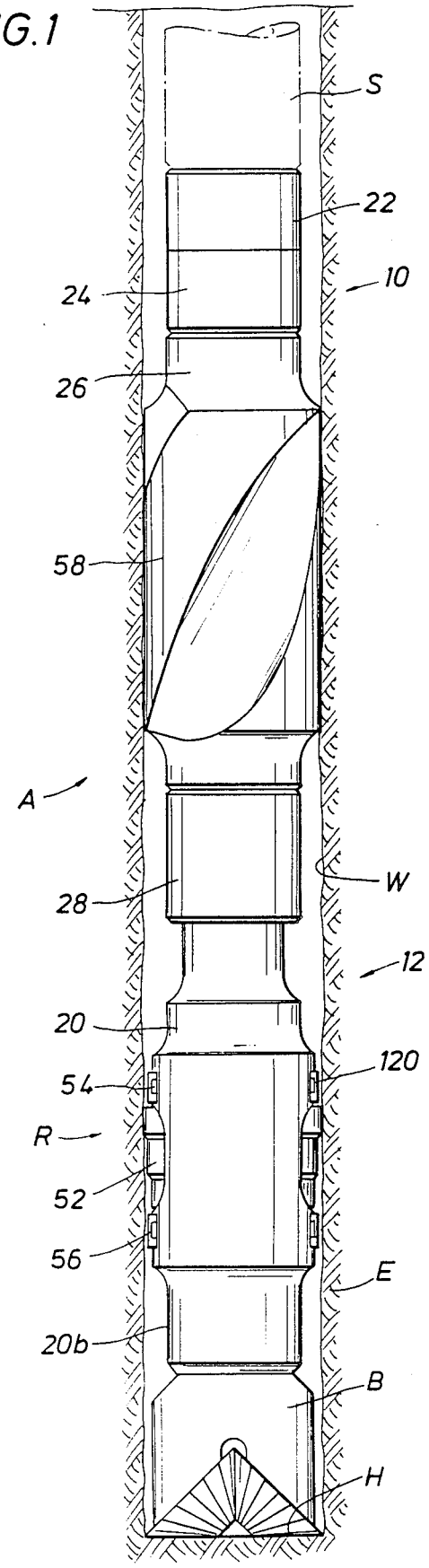
FIG. 1 is a side view, in section, of a bore hole having the drilling tool of the present invention mounted in the rotary drill string immediately above the drill bit.

A drilling tool apparatus embodying the present invention is generally designated A in FIG. 1. The apparatus A is preferably connected in a drill string S immediately above a drill bit B. Rotation of the drill bit B in a desired, conventional manner results in the deepening of a borehole H in the earth E with the attendant formation of borehold walls W. During rotation of the drill string S to rotate the drill bit B the tubular apparatus A, which forms a portion of the drill string S, is rotated in the usual manner. Drilling fluid may be circulated down the drill string S and outwardly through the drill bit B into the well bore H in the usual manner to enhance drilling operations.

Figure 2A:
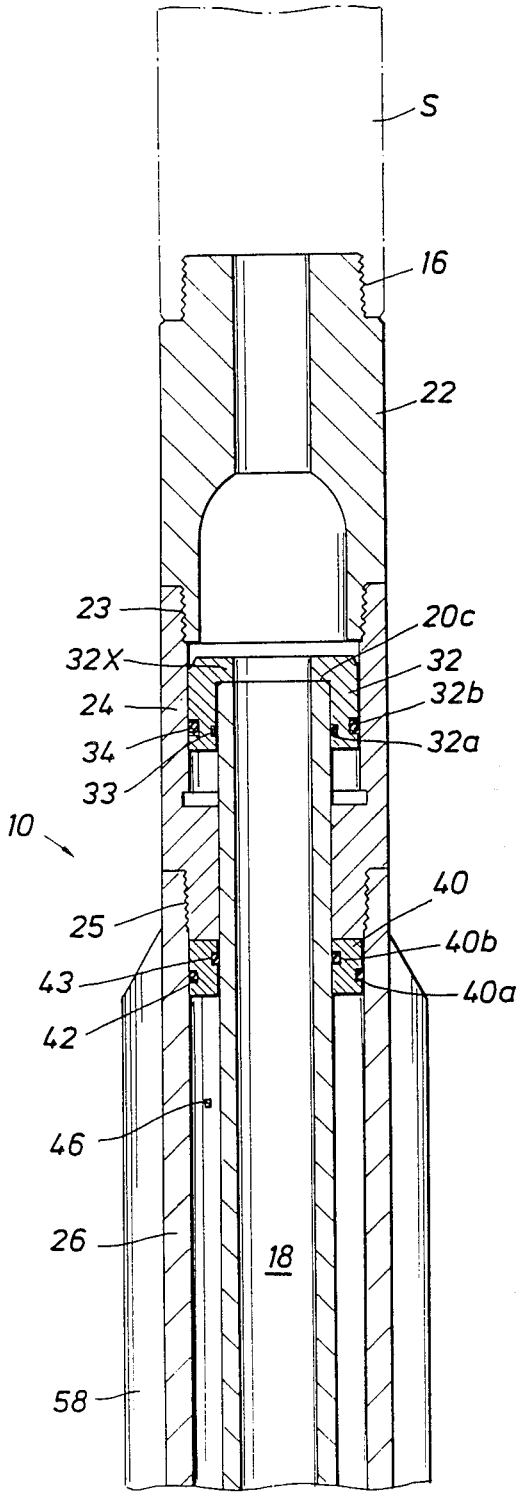
FIGS. 2A and 2B are a partial view, in section, of one form of the drilling tool apparatus of the present invention.
Figure 2B:
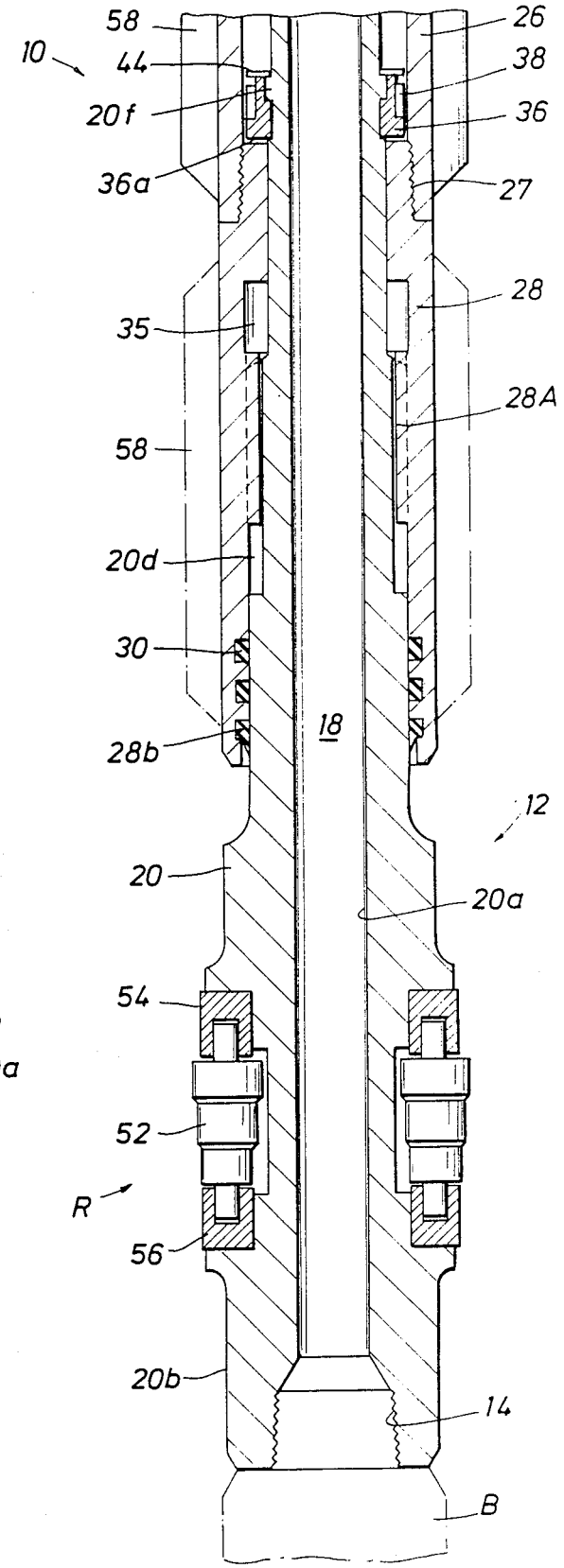

As best illustrated in FIGS. 2A and 2B, the tubular apparatus A includes a first or upper tubular assembly 10 and a second or lower tubular assembly 12. The lower tubular assembly or inner mandrel 12 is preferably provided with downwardly facing female or box helical threads 14 which are preferably connected directly to mating companion threads on the drill bit B. It being understood that the lower threads 14 may be connected to a portion of the drill string S below the tubular apparatus A if desired. The upper tubular assembly 10 is provided with a similar set of conventional helical threads 16 which connect with the drill string S above the tubular apparatus A in the conventional manner. In the illustrated embodiment, the threads 16 are pin threads, but box or female threads may be employed if desired. The tubular apparatus 10 and 12 form a central flow passage or bore 18 for enabling conventional interior flow of drilling fluid through the apparatus A and drill string S to and from the drill bit B.

As illustrated in FIG. 2, the lower tubular assembly or mandrel 12 includes and is preferably formed by an integral tubular member 20 having a substantially cylindrical inner surface **20*a* that partially defines the central or interior flow passage 18 for enabling communication of the drill fluid through the drill string S. The tubular member 20 forms an outer surface 20*b* which extends upwardly from adjacent the lower connecting threads 14 to adjacent the upwardly facing annular shoulder 20*c*. Formed on the outer surface 20*b* is a plurality of conventional spline ribs or outwardly extending projections 20*d*** for a purpose to be described in greater detail hereinafter.

For purposes of assembly the upper tubular assembly 10 is formed by a plurality of threadedly connected tubular members or sections including connecting tubular or sleeve member 22 which forms drill string connecting threads 16. The upper tubular member 22 is sealingly threadedly connected at its lower end at engaged helical sealing threads 23 with a changeable seal sleeve 24. The lower end of the seal sleeve 24 is connected in turn by threaded sealing engagement at 25 with a chamber forming sleeve 26. A lower splined skirt or sleeve 28 is threadedly connected at engaged sealing threads 27 with the chamber forming sleeve 26. The sleeves 24, 25 and 26 are disposed concentrically outwardly of the sleeve 20 to enable desired limited relative longitudinal or telescoping movement between the upper assembly 10 and the lower assembly 12. The tubular sleeves 22 and 24 also form a portion of the bore 18 for enabling communication of the drilling fluid.

The spline sleeve 28 forms a plurality of inwardly projecting splines **28*a* which interfit with the mating splines 20*d* on the lower sleeve 20 to enable relative limited longitudinally movement between the upper tubular assembly 10 and the lower tubular assembly 12 while enabling continuous transmission of torsionally or rotational motion between the upper tubular assembly 10 and the lower tubular assembly 12. This enables a relative telescoping movement or operating stroke of the tubular assemblies to and from an extended position and a shortened or collapsed position. A plurality of annular grooves 28*b* are formed in the spline sleeve 28 below the splines 28*a* for carrying a corresponding plurality of seals 30 which provide a sliding seal between the spline sleeve 28 and the lower sleeve 20 to exclude drilling fluid from the interengaged splines 28*a* and 20*d***.

The lower mandrel 20 carries an annular seal ring 32 which is illustrated in FIG. 2A with an annular lip **32*x* in engagement with the upper end annular shoulder 20c and which may be secured in position, if desired, by threaded engagement. The annular seal ring 32 has an inner groove 32*a* which carries seal 33 to effect a stationary seal with the outer surface 20*b* of the lower sleeve 20. A similar annular groove 32*b* in the outer portion of the seal ring 32 carries seal 34 which effects a sliding seal with the seal sleeve 24 of the upper tubular assembly 10. Fluid pressure in the bore 18 will urge downwardly on an upwardly facing annular pressure responsive shoulder 32*c* of the seal ring 32 for maintaining the seal ring lip 32*x* in engagement with the lower sleeve 20 during the relative telescopic movement of the upper tubular assembly 10 and the lower tubular assembly 12**.

The downward fluid pressure urging on the seal ring 32 and lower mandrel 20 will partially establish the preload deformation of a resilient element by urging the lower tubular assembly to the extended psoition which will be explained in greater detail. The magnitude of the resulting downward preload force on the mandrel 20 is a function of the pressure in the bore and the exposed pressure responsive area of the lower mandrel 20. This pressure responsive area can be varied by changing the diameter on which the 33 and 34 seal in the illustrated embodiment slide. Such change can be accomplished at the rig site by unscrewing or threads 23 and 25 and then installing differently dimensioned seal sleeves 24 and seal ring 32 to establish a different sealing diameter for seal 34. If desired, the seal ring 32 may be furnished without lip **32*x* to make the diameter of the seal 32 the controlling seal size location rather than seal 34**. The flexibility afforded by the variation in or modification to the pressure responsive area can be achieved in the field or drilling site at slight cost and with a minimum of delay. In remote or offshore drilling locations this capability to adapt to unexpected drilling conditions is highly desirable.

The seal 30 and the seals 33 and 34 define the lower and upper sealed ends, respectively, of an enclosed annular expansible chamber 35 formed between the tubular assemblies 10 and 12. During assembly this chamber 35 is automatically filled with air at atmospheric pressure.

The extended position retainer or limit stop for the axial or longitudinal stroke movement of the lower sleeve 20 is provided by a split stop ring 36 (FIG. 2B) that is fixedly mounted on the outer surface **20*b* of the lower sleeve 20 in surrounding relationship about an outwardly projecting annular collar 20***f*. The split stop ring 36 provides a downwardly facing annular shoulder 36*a* that engages the spline sleeve 28 to limit telescopic movement of the lower sleeve 20 to the extended position. A keeper or resilient outer spring 38 maintains the split ring 36 in surrounding engagement with the collar 20*f* to prevent inadvertent separation of the tubular assemblies 10 and 12.

Figure 4A:
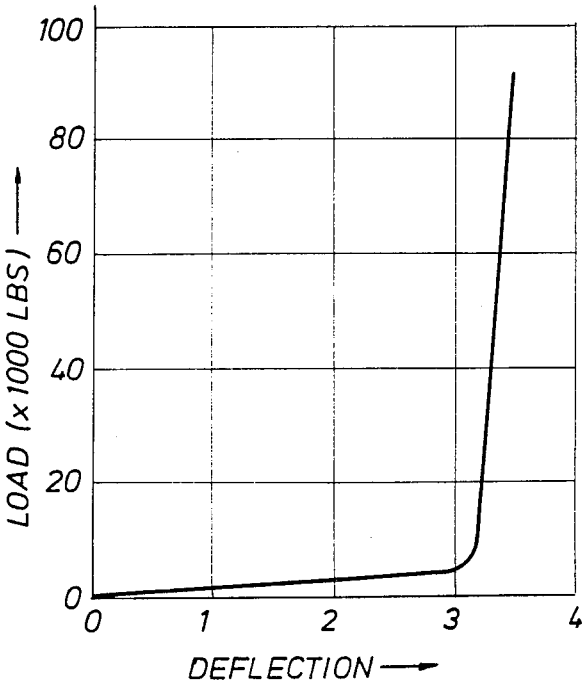
FIGS. 4A and 4B are graph charts showing a spring constant characteristic of a preferred form of shock absorber tool resilient element.
Figure 4B:
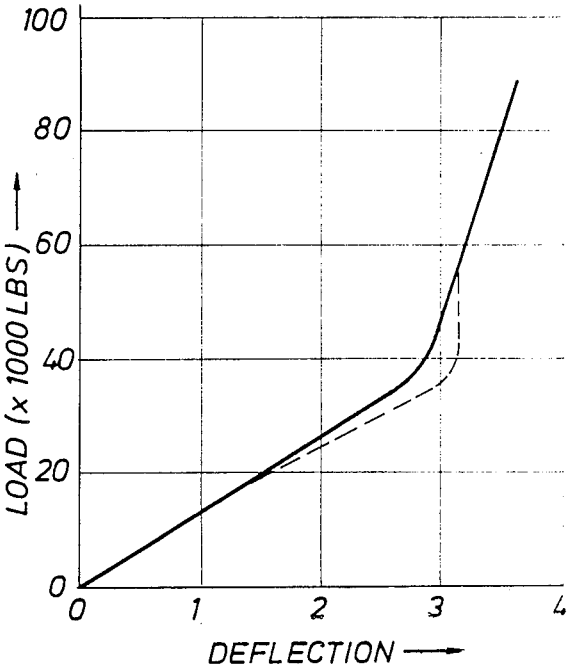

An intermediate seal cartridge 40 (FIG. 2A) is disposed between the inner sleeve 20 and the chamber forming sleeve 26 adjacent threads 25 and held below the seal sleeve 24. The seal cartridge 40 is provided with outer and inner annular recesses 40*a* and 40*b* for receiving seals 42 and 43, respectively, for sealing with the chamber sleeve 26 and the lower sleeve 20. If desired the seals 42 and 43 and their intermediate seals may be omitted. Disposed in the annular chamber 35 between the sealed cartridge 40 and a retainer ring 44 located adjacent the limit stop collar 20*f* is a partially illustrated resilient energy absorbing element 46. The resilient energy absorbing element 46 may be of any suitable conventional type as disclosed in the patents incorporated herein by reference herein for engaging the seal cartridge 40 and retainer 44 for urging and maintaining the tubular assemblies 10 and 12 in the extended position. While any known type of conventional resilient element 48 may be employed, a field replaceable cartridge element 46 formed of an annular arrangement of a stacked alternating series of rubber cushions and Belleville washers has been found to be highly desirable in providing the desired spring constant having the load and deformation characteristics tailored or preselected as illustrated in FIG. 4B. By way of comparison, a typical all metal or Belleville washer resilient urging means spring constant characteristic is graphed in FIG. 4A. When the tubular assemblies 10 and 12 are in the fully extended position, the stroke is graphed as zero. As the tubular assemblies move together the movement stroke is plotted against the force required for such movement to show the spring constant of the resiient means. Another graph example is shown of FIG. 15 of the previously mentioned Mason patent. A shock absorbing tool having the resilient means with the characteristics of FIG. 4A would be preloaded, usually by internal hydrostatic pressure to operate with 3 to 4 inches of deformation. Below three inches of deformation, the spring would be too hard to effectively dampen the drill bit viberations. The spring constant characteristics of Figure 4A are conventional and acceptable for use with tri-cone rotary drill bits which utilize a high bit weight, relatively low rotary speed and a variable flow rate. Due to the large bit weight desired for tri-cone bits the substantially flat portion of the spring characteristic curve of FIG. 4A is acceptable.

The development of drill bits using synthetic or polycrystalline diamond (PCD), such as those sold by General Electric under the mark "Stratapax" have resulted in a need for shock absorbing tools that can operate over a wider range of axial loading on the drill bit. Such PCD bits operation is optimized with reduced weight on the bit, higher bit rotational speed and large flow rates of drilling fluid to cool the drill bit. While such PCD drill bits exhibit exceptional drilling performance, they are expensive and highly vulnerable to damage from impact or shock loading.

The spring characteristics of FIG. 4B is particularly well suited by PCD drill bits and is provided by alternate annular layers of stacked metal springs and rubber elements. Such arrangement provides an additional spring characteristic benefit illustrated in phantom in FIG. 4B. When the tubular sections are compressed or deflected to absorb a load, the rebound or recovery impact is not as sharp. A hysteresis like loss of energy occurs in the stacked resilient elements which dampens the force with which the drill bit again contacts the bottoms of the bore hole. This partial absorbtion of energy reduces the vulnerability of the drill but and particularly PCD bits to damage from the return stroke. While the phenomena is not fully understood, its existence and beneficial effect is fully recognized.

The two part slope of the spring characteristic curve of FIG. 4B is achieved by the initial uniform deformation to about two and a half inches of only the Belleville washers. At about two and one half inches the rubber layers begin to deform and create a transition zone which ends to slightly before three inches of spring deformation. From approximately three to three and a half inches of deformation the force absorption is provided solely by the rubber layers and which provide a more vertical spring constant characteristic for absorbing the larger and more potentially damaging heavier impacts. While the spring constant characteristic can be plotted or determined with reasonable precision, the rebound or hysteresis spring characteristics are now only estimated.

With a known spring characteristic and the anticipated range of certain drilling conditions, the desired resilient element preload for optimum drill bit operation can be determined. For the present apparatus the pertinent range of drilling conditions is the desired weight on the bit, the weight of the drill string below the resilient element, the drilling fluid weight and flow rate as well as the anticipated drill depths. Based on these factors and certain selected tool characteristics to be discussed hereinafter the desired preload deformation on the resilient element can be established. As the resilient cartridge element 46 is field replaceable, immediate flexibility is available to the drilling operation in changing the spring constant of the resilient element in meeting unanticipated drilling conditions.

In accordance with the present invention a bore hole wall contacting reamer generally designated R, is disposed upon the outer surface 20*b* of the lower sleeve 20 adjacent the lower threads 14 and below the outer upper tubular assembly 10. The reamer R, includes a suitable plurality of shaft mounted or shaft forming roller cutters 52 that are rotatably secured to and circumferentially spaced as desired about the lower sleeve 20 by a corresponding plurality of paired vertically aligned mounting or bearing blocks 54 and 56. Both the upper mounting block 54 and lower mounting block 56 are secured to the exterior surface 20*b* by any suitable conventional means such as bolting or the like, but a preferred manner is disclosed. By positioning the wall contacting reamer roller cutters 52 immediately above the drill bit B the bore hole wall W is immediately brought into proper gauge diameter or cylindrical size during the rotary drilling operations while supporting against undesirable lateral movement of the lower sleeve 20. Such lateral support on either tubular assembly 10 or 12 significantly reduces the unsupported bending moment on the splined engagement of the upper and lower tubular assembly 10 and 12 for maintaining the desired drilling direction. By providing such lateral support of the tubular assembly A and drill string S viberation dampening is appreciably enhanced.

Figure 3:
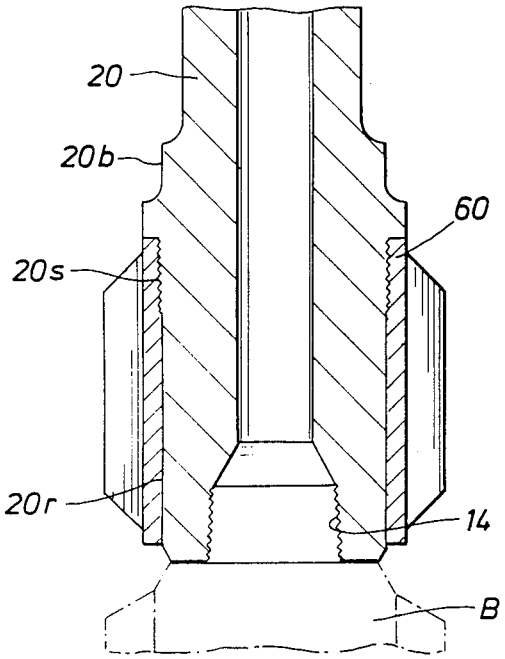
FIG. 3 is a partial side view, in section, of the drilling tool of the present invention illustrating the threaded attachment of a blade stabilizer sleeve to be retained by the drill bit in the event of attachment thread failure.

The upper tubular assembly 10 is also preferably laterally supported against the bore hole walls W by a conventional fixed blade stabilizer having a plurality of conventional wall contacting blades 58 which may be integrally formed. If desired the blades 58 may be also located or welded on the spline sleeve 28 to further protect the telescoping movement of the tubular apparatus from any undesired bending or lateral forces. If desired, the reamer 50 could be mounted on the upper tubular assembly 10 as well as the lower tubular assembly (illustrated). In drilling certain other formations, it may be desirable to run a stabilizer rather than a reamer on the lower tubular assembly 12. A preferred embodiment of a form of stabilizer that may be used on the lower tubular assembly 12 as illustrated in FIG. 3 where the outer tubular surface **20*b* is provided with a constant diameter outer surface portion 20*r* having a threaded portion 20*s*. A threaded stabilizer blade mounting sleeve 60 is then slipped on the surface 20*b* to make up with the threads 20*s*. The sleeve 60 carries a plurality of conventional radially disposed fixed outwardly extending stabilizer blades 60*a* for contacting the borehole wall W. When the bit B is directly connected to the lower threads 14 the stabilizer blade sleeve 60 and the welded or otherwise secured blades 60*a* are captured by the bit B to the lower tubular assembly 12 to avoid creation of an unwanted fish in the event of failure of the threads 20*s***.

The foregoing arrangement provides an axial shock absorber drilling tool apparatus A that is laterally supported by bore hole wall contact on either or both of the lower and upper tubular assemblies 10 and 12 without departing from the scope of the present invention. Such lateral bore hole wall contacting support may be provided by any form of a reamer or stabilizer mounted on either or both of the upper or lower tubular assemblies 10 and 12.

A preferred manner of replaceable or removably mounting the stabilizer blade on a tubular member T mountable in a drill string S is illustrated in FIGS. 7, 8 and 9. The blade mounting assembly includes a bracket body 70 forming an elongated blade receiving slot 72 in which a flared portion 74 of the stabilizer blade 76 is removably received and secured. The slot 72 forms a pair of spaced apart parallel blade support walls 80 and 82 for receiving therebetween the complementary mounting support enlarged or flared portion 74 of the blade 76. The support walls 80 and 82 are undercut and preferably formed in a symmetrical dove-tail to prevent radially outward movement of the flared or enlarged mounting portion 74 of the stabilizer blade 76. The precise cross-section of the undercut is subject to variation in shape so long as the bracket prevents radial outward movement of the blade from the slot. The bracket body 70 may be formed separately and secured to the tubular assembly by welding as illustrated at **70*a* or the like or, if desired, may be machined integrally in the tubular member T or either tubular assembly 10 or 12**.

One end of the blade receiving slot 72 is preferably closed by a permanent end closure 84 fixed to the tubular member T for preventing movement of the blade 76 from that end of the slot 72. The other end of the slot is open for enabling sliding insertion and removable of the blade from the slot 72 at the drill site.

A movable blade retainer 86 for closing the open end of the blade receiving slot 72 is positioned adjacent the blade 76 after it has been received in the slot 72. A threaded bolt 88 is received in a threaded opening **86*a* formed in the fixed end closure 86 to operably connect with the blade retainer 86 for tightly clamping the ends of the blade in the slot 72. The fixed slot closure member 84 has a stepped diameter opening 84a for receiving and connecting with the bolt head 88*a*. The portion of the slot 72 adjacent the fixed end closure 84 is formed with a taper 84*b* to wedge the enlarged portion 74 of the blade 76 upwardly or outwardly into securing contact with the blade support walls 80 and 82 upon rotational tightening of the threaded bolt 88. The movable closure member 86 is also provided with a similar tapered or wedging surface adjacent the blade 76 for fully forcing the enlarged portion 74 of the stabilizer blade 76 positioned in the slot 72 into full securing engagement or contact with the blade support walls 80 and 82 upon tightening of the bolt 88. Preferably, the blade 76 is provided with a longitudinally opening 76*a* in the flared portion 74 through which the bolt 88 extends in order that the bolt 88 may retain the blade 76 in the unlikely event of failure of the bracket 70** during rotary drilling operations. The preferred stabilizer blade mounting apparatus permits blade changes to be rapidly performed in the field with a minimum loss of drilling time.

Figure 5:
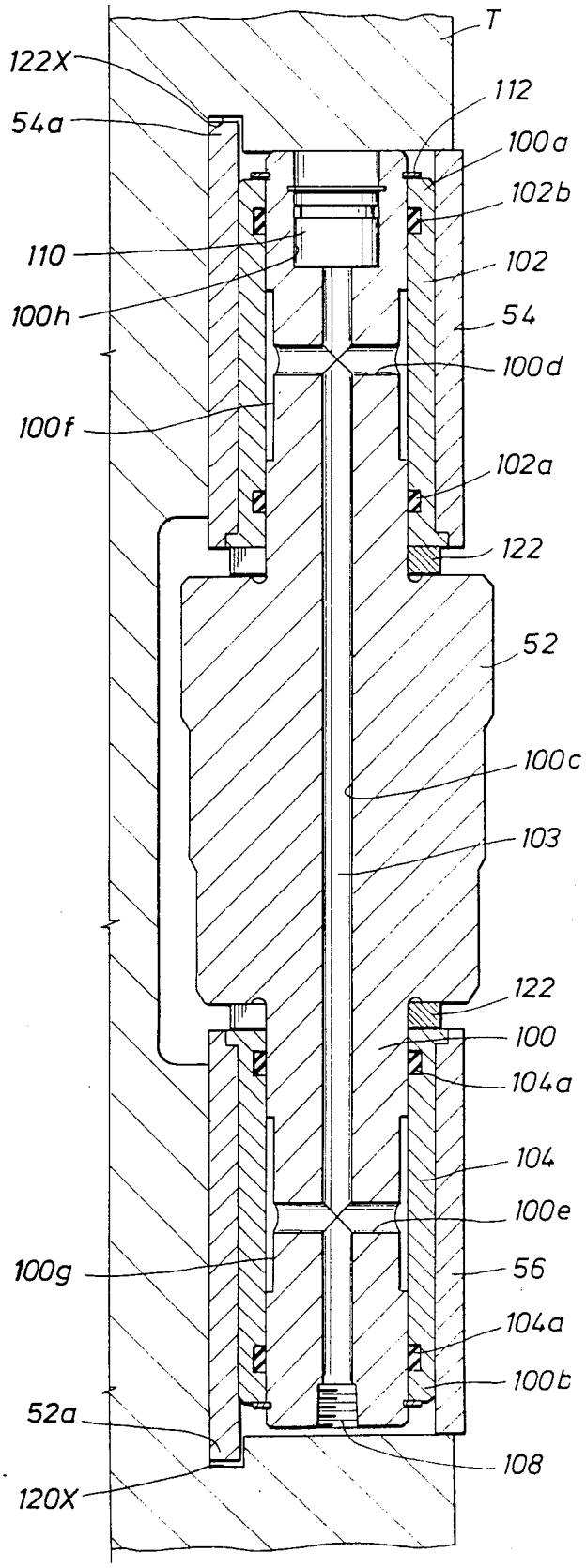
FIG. 5 is a side view, in section, of a preferred mounting arrangement for the roller reamer.

The present invention also includes a preferred manner of attaching the plurality of reamer roller cutters to the tubular body T or to the tubular apparatus A in FIG. 5. In the preferred embodiment the roller cutter blade 52, which may be provided with any desired cutting configuration and formed of any suitable material of construction either forms (illustrated) or is mounted on a tubular shaft 100 which forms a longitudinal axis for the cutting blade and provides a first shaft end **100*a* and a second shaft end 100*b* that extend outwardly of either end of the roller cutter 52. The ends of the shaft 100*a* and 100*b* are received in pillow or mounting blocks 54 and 56, respectively, which are secured to the exterior surface of the tubular member T. The mounting blocks are preferably shaped to avoid potentially damaging contact with the wall W of the borehole H during rotary drilling operations. Each mounting block 54 and 56 is provided with an opening 54*a* and 52*a* preferably receiving a field replaceable bearing sleeve bushing 102 and 104 which is axially or slidable on the shaft ends 100*a* and 100*b*. The bearings bushing 102 and 104 provide radial rotational support for the journalled ends 100*a* and 100*b* of the shaft 100** in the conventional manner. They are also unable to rotate with the cutter because of the bolts.

Preferably, each bearing bushing 102 and 104 carries a pair of longitudinally spaced packings or O-rings **102*a*, 102*b*, 104*a* and 104*b* for sealing the shaft at spaced locations in order that the bearing contact with the shaft journals may be protected from exposure to undesired solid matter in the drilling fluid. If desired, the shaft bearings 102 and 104 and journals 100*a* and 100*b* can be lubricated during operation by a grease or other viscous liquid lubricant provided in a common chamber 103. To form the common lubricating chamber 103 the shaft 100 is drilled longitudinally or axially to provide a central passage 100*c* and cross drilled at operating locations 100*d* and 100*e* intermediate of the pairs of spaced seals 102*a*, 102*b*, 104*a* and 104*b* with the mounting blocks 54 and 56 to communicate the sealed portions of the two bushings through the central passageway 100*c*. If desired, recessed grooves 100*f* and 100*g* may be cut or provided on the outer surface of the shaft 100 adjacent the cross drilling locations 100*d* and 100*e* to insure proper fluid distribution and adequate supply of lubricant. A threaded plug 108 at one end of the longitudinal central drilled passageway in the shaft may be used as a fill port for the lubricant with the plug 108 preventing escape of the lubricant after filling. Due to the symmetrical nature of the shaft 100 it is possible to install the fill plug 108 in the lower position illustrated, but the preferred position is with the fill plug 108 at the upper installed end. If it is desired to equalize the pressure of the liquid lubricant adjacent the seals and the pressure adjacent the exterior of the tool T and the roller cutter 52, a pressure equalization cartridge may be provided which is located generally at 110 in FIG. 5. To provide adequate protected space for the pressure equalization cartridge, the end of the shaft 100 opposite the fill plug 108 has the passageway 100*c* countersunk or drilled to a large diameter portion to provide an enlarged opening 100*h* for receiving the cartridge 110. The cartridge 110 is secured in position after insertion by a gapped retainer snap ring 112 which radially expands into a groove 100*j* formed in the countersunk portion 100*h***.

Figure 6:
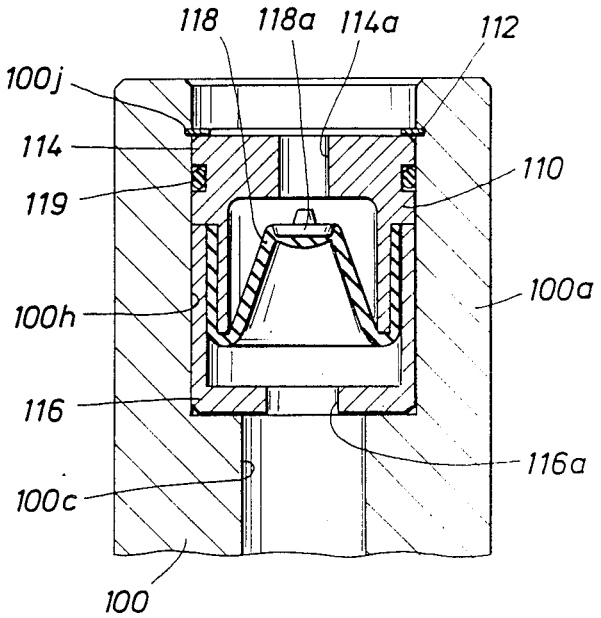
FIG. 6 is a view of a seal and pressure equalization assembly for an expansible lubrication chamber that is well suited for use with reamer roller seal bearings.

The pressure equalization cartridge 110 is illustrated in greater detail in FIG. 6. The cartridge 110 is formed by a two piece tubular body 114 and 116 that fits snugly in the larger diameter portion **100*h* and which mounts a flexible diaphragm 118 which moves in rsponse to pressure variations to equalize the fluid pressure on either side thereof. The diaphragm 118 is provided with a metal closure cap 118*a* for flexure protection of the diaphragm 118 during assembly, transportion or running of the reamer tool. The cartridge 110 is formed by a first body sleeve 114 having a central flow port 114*a* aligned and co-acting with the metal pad 118*a* of the diaphragm 118 for enabling communication of the pressure adjacent the exterior of the tool to the diaphragm 118 and a positioning or retainer sleeve 116. The diaphragm 118 is retained to the body 114 by telescoping interfit with the retainer cartridge body 116 and which is also ported at 116*a* for enabling communication of the lubricant to the other side of the diaphragm 118. A seal 119 carried by the body 114 prevents leakage of fluid between the cartridge body 110 and the shaft 100 while the snap ring 112 retains the cartridge 110 in the shaft 100 during operation. During assembly of the roller cutter mounting assembly, the cartridge 110 is installed and secured in the manner illustrated before the shaft ends 100*a* and 100*b* are slidably positioned in the mounting blocks 54 and 56. The mounting blocks 54 and 56 are then slidably and sealingly positioned closely adjacent the roller cutter 52. The lubricating chamber 103 is then filled with a liquid or grease lubricant and the plug closure 108 installed when filling is complete. The partially assembled mounting apparatus is then positioned on the reamer tool T and the mounting brackets 52 and moved outwardly along the shaft 100 for positioning the outwardly extending projections 52*a* and 54*a* of the mounting blocks 52 in facing undercut recesses 120*a* and 122*a* formed in the outer surface 20*b* of the tubular body 20. Suitable conventional threaded bolting 120 is then installed to secure the mounting blocks 54 and 56 to the tool body and prevent further axial movement of the blocks 54 and 56 along the shaft 100 and to maintain the projecting lugs 54*a* and 56*a* in the securing recesses. The projecting lugs 54*a* and 56*a* serve to retain the mounting blocks 54 and 56 with the reamer tool tubular body T in the event of a bolt 120 failure and thereby avoids the formation of an undesired fish in the bore hole. With the mounting blocks 54 and 56 secured to the tool T the roller cutter blade 52 is free to float back and forth axially a limited amount. This axial movement is eliminated by then installing deformable C-shaped clamps or washers 122 that are sufficiently resilient to enable installation and which serve as spacers or thrust bearing to properly position the roller cutter 52 between the mounting blocks 54 and 56. Preferably, the C-shaped spacer washers are installed on both sides of the roller cutter 52 to engage the mounting blocks 54 and 56 and block axial movement of the roller cutter 52 and shaft 100 in either axial direction. During disassemby the spacing C-shaped washers 122** are first removed and discarded and the assembly procedures performed in reverse order. Such roller cutter mounting is field repairable, enables the optimum cutters to be used for any formations encountered and requires a minimum spare part inventory at the drill site.

The foregoing disclosure and description of the invention are illustrative and explanatory thereof, and various changes in the size, shape and materials, as well as in the details of the illustrated construction, may be made without departing from the spirit of the invention.

What is claimed is:

1. A mounting bracket assembly for a blade of a fixed blade stabilizer, including:

a bracket body forming a blade receiving slot having a pair of spaced apart blade support walls for removably receiving therebetween a portion of the blade, said slot having and end closure for preventing movement of the blade from said slot, said slot having an open end for enabling insertion and removal of the blade from said slot;

a securing bolt having a first and second end and threaded sufficiently for securing the blade in said slot upon tightening of said bolt, at least one end of said bolt operably securable to said end closure;

a movable blade retainer for closing said open end of said blade receiving slot, said blade retainer operably connected with said bolt for forcing against the received blade upon tightening of the bolt, said blade retainer forming a wedging surface for forcing the portion of the stabilizer blade positioned in said slot into securing engagement with said blade support walls upon tightening of said bolt.

2. The mounting bracket assembly as set forth in claim 1, wherein:

said bracket body forming a wedging surface adjacent said end closure for forcing the stabilizer blade positioned in said slot into securing engagement with said blade support walls upon tightening of said bolt.

3. The mounting bracket assembly as set forth in claim 1, wherein:

said blade support walls are tapered for forming a dove-tail slot for securing with corresponding dove-tail securing surfaces formed on the slot received portion of the blade.

4. The mounting bracket assembly as set forth in claim 1, wherein:

at least one of said blade support walls is shaped with an under cut for wedgedly securing with a corresponding shaped surface formed on the slot received portion of the blade to preclude movement of the blade from said slot.

5. The mounting bracket assembly as set forth in claim 1, wherein:

said bracket body is integrally formed on the exterior of a tubular member.

6. The mounting bracket assembly as set forth in claim 1, wherein:

said bracket body is secured to the exterior of a tubular member.

7. A fixed blade stabilizer tool adapted for use in a drill string during rotary drilling operations to form a bore hole, including:

a tubular member forming an outer surface and having upper and lower threaded connections for mounting said tubular member at a desired location in the drill string;

at least one bore hole wall contacting blade fixedly disposed on said outer surface of said tubular member for radially enlarging the bore hole and for supporting the drill string in the bore hole;

means for mounting said blade on said tubular member including a bracket body having a blade receiving slot forming a pair of blade support walls for removably receiving therebetween a portion of said borehole wall contacting blade, and end closure for one end of said slot to block movement of said blade from said slot;

said slot having an open end for enabling insertion and removal of the blade as desired from said slot;

a moveable blade retainer for closing said open end of said blade receiving slot, means for securing said movable blade retainer to said end closure; and said blade retainer forming a wedging surface for forcing the portion of the stabilizer blade positioned in said slot into securing engagement with said blade support walls upon securing of said movable blade retainer to said end closure.

8. The stabilizer tool as set forth in claim 7, wherein:

at least one of said blade support walls are undercut to prevent movement of said blade from said slot.

9. The stabilizer tool as set forth in claim 7, wherein:

said blade support walls are tapered to form a dovetail mounting for the portion of said blade received therein.

10. The stabilizer tool as set forth in claim 7, wherein:

said end closure having an opening extending therethrough;

a threaded securing bolt extending through said opening and operably connected with said movable blade retainer for securing the blade between said end closure and blade retainer upon tightening of said threaded bolt.

11. The stabilizer tool as set forth in claim 10, including:

said borehole wall contacting blade having an opening extending therethrough for enabling positioning of said bolt through said blade to retain said blade on said bolt in the event of failure of said bracket body.

12. The stabilizer tool as set forth in claim 7, wherein:

said end closure having a tapered portion for forcing the portion of the stabilizer blade positioned in said slot into securing engagement with said blade support walls upon securing said movable blade retainer to said end closure.

* * * * *